US010561177B2

(12) United States Patent
Plunkett et al.

(10) Patent No.: US 10,561,177 B2
(45) **Date of Patent: *Feb. 18, 2020**

(54) ELECTRONIC SMOKING ARTICLE

(71) Applicant: Altria Client Services LLC, Richmond, VA (US)

(72) Inventors: Susan E. Plunkett, Richmond, VA (US); David B. Kane, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/197,467

(22) Filed: Nov. 21, 2018

(65) Prior Publication Data

US 2019/0082742 A1 Mar. 21, 2019

Related U.S. Application Data

(63) Continuation of application No. 15/678,402, filed on Aug. 16, 2017, now Pat. No. 10,136,678, which is a continuation of application No. 14/185,230, filed on Feb. 20, 2014, now Pat. No. 9,848,644.

(60) Provisional application No. 61/768,100, filed on Feb. 22, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 4,091,264 | A | 5/1978 | Sarcia | |
| 4,617,232 | A | 10/1986 | Chandler et al. | |
| 4,995,547 | A | 2/1991 | Schubert et al. | |
| 5,018,259 | A | 5/1991 | Wildman | |
| 5,595,706 | A | 1/1997 | Sikka et al. | |
| 5,649,554 | A | 7/1997 | Sprinkel et al. | |
| 5,878,752 | A | 3/1999 | Adams et al. | |
| 6,627,116 | B1 | 9/2003 | Suda et al. | |
| 7,167,776 | B2 * | 1/2007 | Maharajh | F22B 1/28 700/266 |
| 8,794,231 | B2 | 8/2014 | Thorens et al. | |

(Continued)

FOREIGN PATENT DOCUMENTS

| | | | |
|---|---|---|---|
| CN | 1045691 | A | 10/1990 |
| CN | 1205849 | A | 1/1999 |

(Continued)

OTHER PUBLICATIONS

International Search Report dated May 27, 2014.

(Continued)

*Primary Examiner* — Eric Yaary
(74) *Attorney, Agent, or Firm* — Harness, Dickey & Pierce, P.L.C.

(57) ABSTRACT

An electronic smoking article includes a liquid supply region including liquid material and a heater-wick element operable to wick liquid material and heat the liquid material to a temperature sufficient to vaporize the liquid material and form an aerosol. The heater-wick element is formed of a carbon or graphite foam.

21 Claims, 2 Drawing Sheets

(56) References Cited

U.S. PATENT DOCUMENTS

| | | | | |
|---|---|---|---|---|
| 2003/0000486 | A1 | 1/2003 | Ott et al. | |
| 2005/0016549 | A1 | 1/2005 | Banerjee et al. | |
| 2006/0193981 | A1 | 8/2006 | Wheat et al. | |
| 2009/0272379 | A1 | 11/2009 | Thorens et al. | |
| 2009/0308795 | A1 | 12/2009 | Smith | |
| 2010/0051028 | A1* | 3/2010 | Kleinschmidt ..... | A61M 16/18 128/204.13 |
| 2010/0272421 | A1 | 10/2010 | Liu et al. | |
| 2011/0226236 | A1 | 9/2011 | Buchberger | |
| 2011/0253798 | A1 | 10/2011 | Tucker et al. | |
| 2012/0024837 | A1 | 2/2012 | Thompson | |
| 2012/0255567 | A1 | 10/2012 | Rose et al. | |
| 2013/0228191 | A1 | 9/2013 | Newton | |
| 2013/0255702 | A1 | 10/2013 | Griffith, Jr. et al. | |
| 2013/0306065 | A1 | 11/2013 | Thorens et al. | |
| 2014/0000638 | A1 | 1/2014 | Sebastian et al. | |
| 2014/0020693 | A1 | 1/2014 | Cochand et al. | |
| 2014/0060555 | A1 | 3/2014 | Chang et al. | |

FOREIGN PATENT DOCUMENTS

| | | | |
|---|---|---|---|
| CN | 1345529 | A | 4/2002 |
| CN | 201379072 | Y | 1/2010 |
| CN | 101878958 | A | 11/2010 |
| CN | 201767029 | U | 3/2011 |
| CN | 201830900 | U | 5/2011 |
| CN | 102264420 | A | 11/2011 |
| CN | 202354377 | U | 8/2012 |
| CN | 202456410 | U | 10/2012 |
| EP | 0358020 | A2 | 3/1990 |
| EP | 2340729 | A1 | 7/2011 |
| EP | 2460423 | A1 | 6/2012 |
| EP | 2460424 | A1 | 6/2012 |
| EP | 2468117 | A1 | 6/2012 |
| RU | 2009107275 | A | 9/2010 |
| WO | WO-031034847 | A1 | 5/2003 |
| WO | WO-2009/132793 | A1 | 11/2009 |

OTHER PUBLICATIONS

U.S. Office Action dated May 21, 2016 issued in co-pending U.S. Appl. No. 14/185,259.
U.S. Office Action dated Jul. 15, 2016 issued in co-pending U.S. Appl. No. 14/185,259.
U.S. Office Action dated Mar. 22, 2016 issued in co-pending U.S. Appl. No. 14/185,299.
U.S. Office Action dated Jul. 15, 2016 issued in co-pending U.S. Appl. No. 14/185,299.
International Search Report PCT/ISA/210 for International Application No. PCT/US2014/017433 dated May 21, 2014.
International Preliminary Report on Patentability dated Feb. 21, 2014, issued in corresponding PCT Application No. PCT/US2014/017593.
Written Opinion of the International Searching Authority PCT/ISA/237 for International Application No. PCT/US2014/017593 dated Feb. 22, 20143.
Kazakhstan Office Action dated Nov. 7, 2016 issued in corresponding Kazakhstan Application No. 2015/1042.1.
Kazakhstan Office Action dated Nov. 16, 2016 issued in corresponding Kazakhstan Application No. 2015/1044.1.
European Office Action dated Dec. 5, 2016 issued in corresponding European Patent Application No. 14708441.2.
Chinese Office Action dated Mar. 1, 2017 issued in corresponding Chinese Patent Application No. 21480010167.4 (English translation provided).
Chinese Office Action dated Mar. 8, 2017 issued in corresponding Chinese Patent Application No. 21480010152.8 (English translation provided).
Chinese Office Action dated Mar. 28, 2017 issued in corresponding Chinese Patent Application No. 201480010181.4 4.
European Examination Report dated Aug. 7, 2017 for European Application No. EP 14 708 441.2.
Third Party Observation dated May 19, 2017 for European Application No. EP 14 708 441.2.
Chinese Office Action corresponding to Chinese Application No. 201480010152.8 dated Aug. 14, 2017.
Office Action for corresponding U.S. Appl. No. 14/185,259 dated Oct. 16, 2017.
Office Action for corresponding Russian Application No. 2015140108 dated Oct. 25, 2017 and English translation thereof.
Office Action for corresponding Chinese Application No. 201480010152.8 dated Nov. 16, 2017 and English translation thereof.
Office Action for corresponding Chinese Application No. 201380010167.4 dated Nov. 23, 2017 and English translation thereof.
Examination Report for corresponding European Application No. 14709069.0 dated Feb. 27, 2018.
Examination Report for Corresponding European Application No. 14708434.7 dated Feb. 27, 2017.
Office Action for corresponding Russian Application No. 2015140077 dated Feb. 16, 2018 and English translation thereof.
Office Action for corresponding Russian Application No. 2015140778 dated Feb. 16, 2018 and English translation thereof.
Ukrainian Office Action for corresponding Ukrainian Application No. a 2015 08992 dated Mar. 3, 2018 and English translation thereof.
European Office Action for corresponding European Application No. 14708441.2 dated Apr. 3, 2018.
Chinese Office Action for corresponding Chinese Application No. 201480010152.8 dated Mar. 21, 2018 and English translation thereof.
Office Action for corresponding Chinese Application No. 201480010167.4 dated Jun. 14, 2018 and English translation thereof.
Chinese Office Action dated Oct. 8, 2018 for corresponding Chinese Patent Application No. 201480010152.8.
Malaysian Office Action dated Oct. 31, 2018 for corresponding Malaysian Patent Application No. PI 2015002073.
Examination Report for corresponding Indian Application No. 5074/CHENP/2015 dated Apr. 23, 2019.
Malaysian Office Action dated Nov. 15, 2018 for corresponding Malaysian Application No. PI 2015002092.
Substantive Examination Adverse Report for corresponding Malaysian Application No. PI 2015002077 dated Apr. 15, 2019.
Examination Report for corresponding Indian Application No. 5073/CHENP/2015 dated Jul. 5, 2019.

* cited by examiner

ELECTRONIC SMOKING ARTICLE

CROSS-REFERENCE TO RELATED APPLICATION(S)

This application is a continuation under 35 U.S.C. § 120 of U.S. application Ser. No. 15/678,402, filed Aug. 16, 2017, which is a continuation under 35 U.S.C. § 120 of U.S. application Ser. No. 14/185,230, filed Feb. 20, 2014, which claims priority under 35 U.S.C. § 119(e) to U.S. Provisional No. 61/768,100, filed on Feb. 22, 2013, the entire contents of each of which are incorporated herein by reference.

SUMMARY

An electronic smoking article is provided which includes a heater-wick element which wicks liquid and heats the liquid material to produce an aerosol or "vapor". The heater-wick element is formed of graphite or carbon foam. The heater-wick element includes a wicking portion and a heatable portion, which are integrally formed.

DETAILED DESCRIPTION

Figure 1:
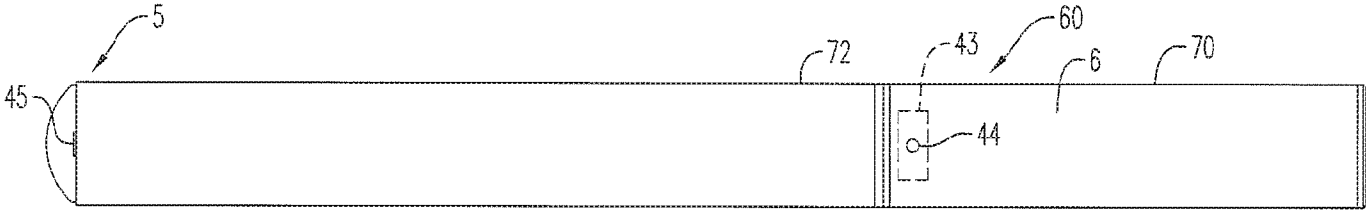
FIG. 1 is a top planar view of an electronic smoking article according to a first embodiment.
Figure 2:
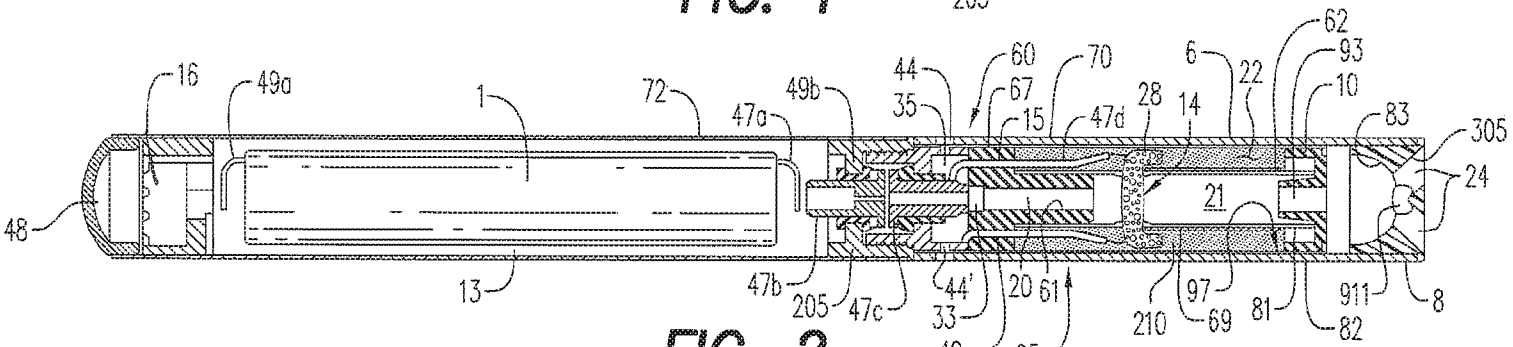
FIG. 2 is a side cross-sectional view of the electronic smoking article shown in FIG. 1 including a heater-wick element as described herein.
Figure 4:
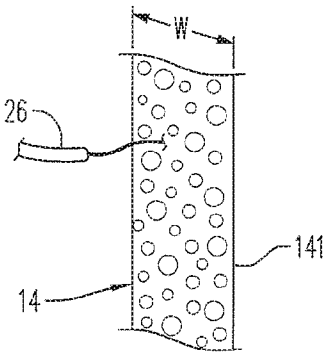
FIG. 4 is an enlarged view of an electrical connection for a heater-wick element as described herein.

Referring to FIGS. 1 and 2, an electronic smoking article (article) 60 is provided and comprises a replaceable cartridge (or first section) 70 and a reusable fixture (or second section) 72, which in the preferred embodiment are coupled together at a threaded connection 205 or by other convenience such as a snug-fit, detent, clamp and/or clasp. Generally, the second section 72 includes a puff sensor 16 responsive to air drawn into the second section 72 via an air inlet port 45 adjacent the free end or tip of the smoking article 60, a battery 1 and control circuitry. The disposable first section 70 includes a liquid supply region of 22 including liquid and a heater-wick element 14 that wicks liquid from the liquid supply region 22 and heats the liquid to form an aerosol in a central air channel 21. Upon completing the threaded connection 205, the battery 1 is electrically connected with the heater-wick element 14 of the first section 70 upon actuation of the puff sensor. Air is drawn primarily into the first section 70 through one or more air inlets 44.

In the preferred embodiment, once the liquid of the cartridge is spent, only the first section 70 is replaced. An alternate arrangement includes a layout where the entire article 60 is disposed once the liquid supply region is depleted. In such case the battery type and other features might be engineered for simplicity and cost-effectiveness, but generally embodies the same concepts as in the preferred embodiment in which the second section is reused and/or recharged.

In a preferred embodiment, the electronic smoking article 60 is about the same size as a conventional smoking article.

In some embodiments, the electronic smoking article 60 can be about 80 mm to about 110 mm long, preferably about 80 mm to about 100 mm long and about 7 mm to about 8 mm in diameter. For example, in a preferred embodiment, the electronic smoking article is about 84 mm long and has a diameter of about 7.8 mm.

Preferably, at least one adhesive-backed label is applied to the outer tube 6. The label completely circumscribes the electronic smoking article 60 and can be colored and/or textured to provide the look and/or feel of a traditional smoking article. The label can include holes therein which are sized and positioned so as to prevent blocking of the air inlets 44.

The first section 70 includes an outer tube (or casing) 6 extending in a longitudinal direction and an inner tube (or chimney) 62 coaxially positioned within the outer tube 6. Preferably, a nose portion 61 of an upstream gasket (or seal) 15 is fitted into an upstream end portion 65 of the inner tube 62, while at the same time, an outer perimeter 67 of the gasket 15 provides a liquid-tight seal with an interior surface of the outer casing 6. The upstream gasket 15 also includes a central, longitudinal air passage 20, which opens into an interior of the inner tube 62 that defines a central channel 21. A transverse channel 33 (shown in FIG. 2) at a backside portion of the gasket 15 intersects and communicates with the central channel 20 of the gasket 15. This channel 33 assures communication between the central channel 20 and a space 35 (see FIG. 2) defined between the gasket 15 and a cathode connector piece 37. In the preferred embodiment, the piece 37 includes a threaded section for effecting the threaded connection 205.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. Preferably, the material is light and non-brittle.

In the preferred embodiment, as shown in FIGS. 1 and 2, the electronic smoking article 60 includes at least one air inlet 44 formed in the outer tube 6, preferably adjacent the threaded connection 205 to minimize the chance of a smoker's fingers occluding one of the inlets and to control the resistance to draw (RTD) during smoking. In the preferred embodiment, the air inlets 44, 44' are sized and configured such that the electronic smoking article 60 has a RTD in the range of from about 60 mm $H_2O$ to about 150 mm $H_2O$, more preferably about 90 mm $H_2O$ to about 110 mm $H_2O$, most preferably about 100 mm $H_2O$ to about 130 mm $H_2O$.

In the preferred embodiment, the second section 72, includes an air inlet 45 at an upstream end 5 of the smoking article 60, which is sized just sufficient to assure proper operation of the puff sensor 16, located nearby. Drawing action upon the mouth end insert 8 is communicated to the air inlet port 45 through central channels provided in the anode post 47*c* of the first section 70 and the anode connection post 47*b* of the second section 72 and along space 13 between the battery 1 and the casing of the second section 72. The air inlet port 45 is sized such that the airflow rate therethrough is much smaller than the airflow rates through the air inlets 44, 44', so that the impact on RTD is minimized and consistency in RTD is maintained. For example, each air inlet 44, 44' can be less than about 2.0 mm in width and less than about 1.5 mm in length.

Preferably, a nose portion 93 of a downstream gasket 10 is fitted into a downstream end portion 81 of the inner tube 62. An outer perimeter 82 of the gasket 10 provides a substantially liquid-tight seal with an interior surface 97 of the outer casing 6. The downstream gasket 10 includes a central channel 93 disposed between the central passage 21 of the inner tube 62 and the interior of the mouth end insert 8 and which communicates aerosol from the central passage 21 to the mouth end insert 8.

In the preferred embodiment, the liquid supply region 22 is contained in an outer annulus between inner tube 62 and outer tube 6 and between the gaskets 10 and 15. Thus, the liquid supply region 22 at least partially surrounds the central air passage 21. The liquid supply region 22 comprises a liquid material and optionally a liquid storage medium operable to store the liquid material therein.

Preferably, the liquid storage medium is a fibrous material comprising cotton, polyethylene, polyester, rayon and combinations thereof. Preferably, the fibers have a diameter ranging in size from about 6 microns to about 15 microns (e.g., about 8 microns to about 12 microns or about 9 microns to about 11 microns). The liquid storage medium can be a sintered, porous, sponge, or foamed material. Also preferably, the fibers are sized to be irrespirable and can have a cross-section which has a y shape, cross shape, clover shape or any other suitable shape. In one embodiment, the liquid storage medium may comprise a winding of cotton gauze or other fibrous material about the inner tube 62. In the alternative, the liquid supply region 22 may comprise a filled tank lacking a fibrous storage medium and containing only liquid material.

Also preferably, the liquid material has a boiling point suitable for use in the electronic smoking article 60. If the boiling point is too high, the heater-wick element 14 will not be able to vaporize the liquid. However, if the boiling point is too low, the liquid may vaporize even when the heater-wick element 14 is not activated.

Preferably, the liquid material includes a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material and/or a nicotine-free material. For example, the liquid may include water, solvents, ethanol, plant extracts and natural or artificial flavors. Preferably, the liquid further includes an aerosol former. Examples of suitable aerosol formers are glycerine and propylene glycol.

In use, liquid material is transferred from the liquid supply region 22 and/or liquid storage medium via the heater-wick element 14, which includes at least one wicking portion 140 and a heatable portion 141. In the preferred embodiment, the heater-wick element 14 includes two wicking portions 140 and a heatable portion 141 therebetween. Also preferably, the wicking portions 140 and the heatable portion 141 are integrally formed of a single material. Preferably, the heater-wick element 15 is formed of graphite or carbon foam (collectively "foamed carbon"), such as PocoFoam® available from Poco Graphite, Inc. of Decatur, Tex. Preferably, the heater-wick element 14 is non-ceramic.

Preferably, the foam is pure graphite foam or graphite foam with low impurities of less than about 100 ppm, more preferably less than about 10 ppm. Preferably, the foam is resistant to oxidation up to at least about 400° C. in an oxygen atmosphere. The foam preferably has a density of about 0.1 g/cc to about 1.0 g/cc, preferably about 0.5 g/cc. Preferably, the foam has a heat capacity of about 0.5 J/g-K to about 1.0 J/g-K, preferably about 0.7 J/g-K. In addition, the foam preferably has a high open porosity of at least about 90%, more preferably at least about 95%. The open porosity is the fraction of the total volume in which fluid flow takes place due to pores being interconnected. The foam preferably also has a total porosity of at least about 70%, more preferably about 75%. The high open porosity allows the heater-wick element 14 to hold a large volume of liquid and the liquid can travel through and along the foam via the pores. The foam has high thermal conductivity, a low density and is light weight.

Advantageously, the heater-wick element 14 serves as both a wicking medium and a heating element. Thus, the heater-wick element 14 is preferably a single piece (integrally formed) structure and there is no need for a separate wick and heater. As such, the heater-wick element 14 is easy to manufacture and inexpensive as compared to electronic smoking articles including a separate heater and wick. Moreover, the inert carbon or graphite foam may prevent catalyzation and undesired reactions products of the liquid at elevated temperatures, such as aldehydes.

Figure 3:
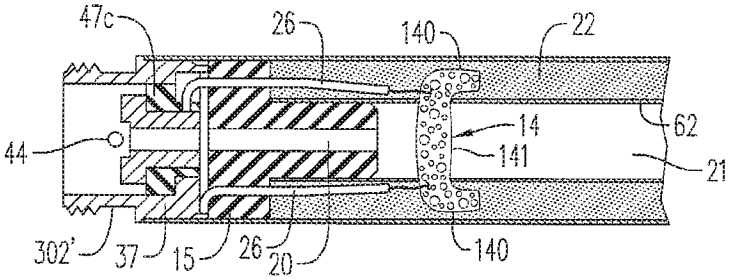
FIG. 3 is an enlarged view of the heater-wick element of FIG. 2.

As shown in FIGS. 2 and 3, the heater-wick element 14 is formed of a graphite or carbon foam. The foam has a high thermal conductivity such that the liquid can be volatilized at a lower applied power, which conserves battery power and prolongs the life of an electronic cigarette as compared to electronic cigarettes utilizing a separate heater and wick formed of different materials.

Figure 5:
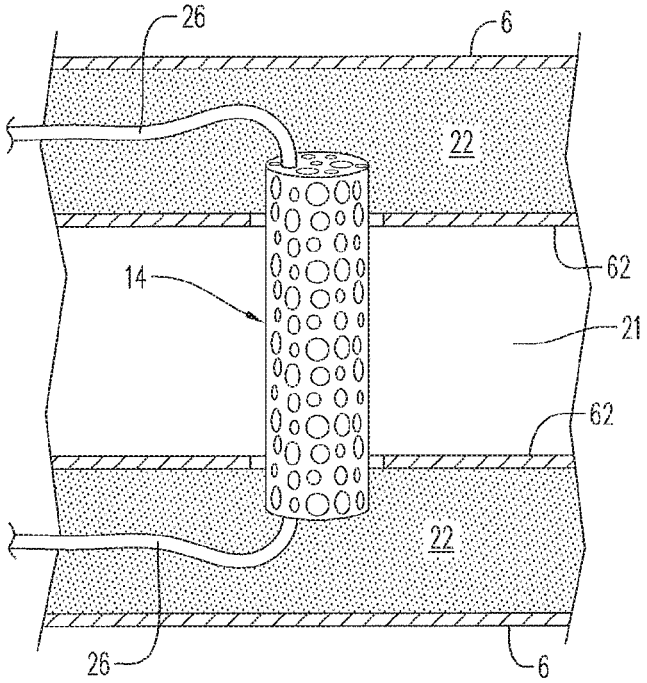
FIG. 5 is an enlarged view of a heater-wick element in the form of a rod.

The heater-wick element 14 have any desired shape, such as a rod (as shown in FIG. 5), a spiral, a block, a cylinder or a ribbon. Preferably, the heater-wick element 14 is substantially rigid. Moreover, the rod or ribbon can be straight, curved, or otherwise shaped to fit within the electronic cigarette.

For example, the heater-wick element 14 can be U-shaped such that the heatable portion 141 is substantially straight and the wicking portions 140 extend upwardly or downwardly into the liquid supply region 22 through opposing slots in a wall of the inner tube 62, as shown in FIG. 3. The slots are large enough so that the heater-wick element 14 can extend therethrough. However, to position irregularly shaped heater-wick elements 14, a slit can be cut in each side of the inner tube 62 and extending from an edge thereof to each slot. The heater-wick element 14 can be slid through the slits and into the slots such that the heater-wick element 14 extends across the central air passage 21 and into the liquid supply region 22.

Preferably, the heater-wick element 14 is substantially uniform in cross-section at least along the heatable portion 141 of the heater-wick element 14. Such uniformity promotes even heating. Alternatively, the heater-wick element 14 can vary in cross-section along the length thereof so as to alter the heating profile of the heater-wick element 14.

As shown, the heater-wick element 14 can extend across the central channel 21 between opposing portions of the liquid supply region 22 and into the liquid supply region 22. Thus, the wicking portion 140 at each end of the heater-wick element 14 extends through slots in the inner tube 62 and into the liquid supply region 22 so as to wick liquid into the heatable portion 141 of the heater-wick element 14, which is positioned within the central air passage 21. A closure ring can slide over an outer surface of the inner tube so as to substantially close off a remainder of open space provided between the heater-wick element and the slot, as described in U.S. Patent Application Publication No. 2013/0192619, filed Jan. 14, 2013, the entire content of which is incorporated herein by reference thereto.

Electrical leads 26 are attached directly to selected locations along the heater-wick element 14, as shown in FIGS.

3 and 4. Since the foam also has a low coefficient of thermal expansion, the foam is dimensionally stable thereby allowing for direct insertion of electrical leads 26 into the foam without the need for a solder or brazing. Alternatively, the electrical leads 26 can be brazed or soldered to the heater-wick element 14. By attaching the electrical leads 26 to the heater-wick element, the electrical current is run ("directed") through the heatable region 141 during a heating cycle. Thus, voltage is applied by the power supply to the heatable portion 141, such that the liquid material in the heatable portion 141 is heated to a temperature sufficient to at least partially volatilize the liquid and form an aerosol.

In a preferred embodiment, the heater-wick element 14 has a ribbon-shape with a length in the range of about 10 mm to about 15 mm, preferably about 12 mm or less, and a width in the range of about 0.5 mm to about 2.0 mm, preferably about 1.5 mm or less. Alternatively, the heater-wick element 14 has a rod or cylindrical shape having a length in the range of about 10 mm to about 15 mm, preferably about 12 mm or less, and a diameter in the range of about 0.5 mm to about 2.0 mm, preferably about 1.5 mm or less. Preferably, the heater-wick element 14 is placed in a transverse direction within the electronic smoking article. In other embodiments, other orientations are possible.

Also preferably, the heater-wick element 14 achieves an electrical resistance ranging from about 0.3 Ohm to about 10 Ohms, more preferably about 0.8 Ohm to about 5.0 Ohms, more preferably about 4.0 Ohms or less.

In addition, liquid can be drawn into the pores of the graphite foam that form the heater-wick element 14. Thus, the liquid moves along the heater-wick element from the wicking portions 140 to the heatable portion 141 via the pores.

Advantageously, the liquid material in the liquid supply region 22 is protected from oxygen (because oxygen cannot generally enter the liquid supply region 22 via the heater-wick element 14). The liquid material is also protected from light so that the risk of degradation of the liquid material is significantly reduced. Thus, a high level of shelf-life and cleanliness can be maintained.

In the preferred embodiment, the liquid supply region 22 is sized and configured to hold enough liquid material such that the electronic smoking article 60 is operable for smoking for at least about 200 seconds, preferably at least about 250 seconds, more preferably at least 300 seconds and most preferably at least about 350 seconds. Thus, liquid supply region 22 is equivalent to about one pack of traditional smoking articles. Moreover, the electronic smoking article 60 can be configured to allow each puff to last a maximum of about 5 seconds.

As shown in FIG. 2, the first section 70 can include a mouth end insert 8 having at least two diverging outlets 24 (e.g., 3, 4, 5 or more, preferably 2 to 10 outlets or more, more preferably 6 to 8 outlets, even more preferably 2 to 6 outlets or 4 outlets). Preferably, the outlets 24 are located off-axis and are angled outwardly in relation to the central channel 21 of the inner tube 62 (i.e., divergently). Also preferably, the mouth end insert (or flow guide) 8 includes outlets 24 uniformly distributed about the perimeter of mouth end insert 8 so as to substantially uniformly distribute aerosol in a smoker's mouth during use and create a greater perception of fullness in the mouth. Thus, as the aerosol passes into a smoker's mouth, the aerosol enters the mouth and moves in different directions so as to provide a full mouth feel. In contrast, electronic smoking articles having a single, on-axis orifice tend to direct its aerosol as single jet of greater velocity toward a more limited location within a smoker's mouth.

In addition, the diverging outlets 24 are arranged and include interior surfaces 83 such that droplets of unaerosolized liquid material, if any, that may be entrained in the aerosol impact the interior surfaces 83 of the mouth end insert 8 and/or impact portions of walls 305 which define the diverging outlets 24. As a result such droplets are substantially removed or broken apart, to the enhancement of the aerosol.

In the preferred embodiment, the diverging outlets 24 are angled at about 5° to about 60° with respect to the longitudinal axis of the outer tube 6 so as to more completely distribute aerosol throughout a mouth of a smoker during use and to remove droplets. In a preferred embodiment, there are four diverging outlets 24 each at an angle of about 40° to about 50° with respect to the longitudinal axis of the outer tube 6, more preferably about 40° to about 45° and most preferably about 42°.

Preferably, each of the diverging outlets 24 has a diameter ranging from about 0.015 inch to about 0.090 inch (e.g., about 0.020 inch to about 0.040 inch or about 0.028 inch to about 0.038 inch). The size of the diverging outlets 24 and the number of diverging outlets 24 can be selected to adjust the resistance to draw (RTD) of the electronic smoking article 60, if desired.

The mouth end insert 8 may be integrally affixed within the tube 6 of the cartridge 70. Moreover, the mouth end insert 8 can be formed of a polymer selected from the group consisting of low density polyethylene, high density polyethylene, polypropylene, polyvinylchloride, polyetheretherketone (PEEK) and combinations thereof. The mouth end insert 8 may also be colored if desired.

In the preferred embodiment, the power supply 1 includes a battery arranged in the electronic smoking article 60 such that the anode 47*a* is downstream of the cathode 49*a*. A battery anode post 47*b* of the second section 72 preferably contacts the battery anode 47*a*.

More specifically, electrical connection between the anode 47*a* of the battery 1 and the heater-wick element 14 in the first section 70 is established through a battery anode connection post 47*b* in the second section 72 of the electronic smoking article 60, an anode post 47*c* of the cartridge 70 and an electrical lead 47*d* connecting a rim portion of the anode post 47*c* with the heater-wick element 14. Likewise, electrical connection between the cathode 49*a* of the battery 1 and the other lead of the heater-wick element 14 is established through the threaded connection 205 between a cathode connection fixture 49*b* of the second portion 72 and the cathode connector piece 37 of the first section 70 and from there through an electrical lead 49*c* which electrically connects the fixture 37 to the opposite lead of the heater-wick element 14.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted or in the case of lithium polymer battery, a minimum voltage cut-off level is achieved.

Alternatively, the power supply 1 may be rechargeable and include circuitry allowing the battery to be chargeable by an external charging device. In that case, preferably the circuitry, when charged, provides power for a pre-determined number of puffs, after which the circuitry must be re-connected to an external charging device. To recharge the electronic smoking article 60, an USB charger or other suitable charger assembly can be used.

Preferably, the electronic smoking article 60 also includes control circuitry including a puff sensor 16. The puff sensor 16 is operable to sense an air pressure drop and initiate application of voltage from the power supply 1 to the heater-wick element 14. As shown in FIG. 2, the control circuitry can also include a heater activation light 48 operable to glow when the heatable portion 141 of the heater-wick element 14 is activated. Preferably, the heater activation light 48 comprises an LED and is at an upstream end of the electronic smoking article 60 so that the heater activation light 48 takes on the appearance of a burning coal during a puff. Moreover, the heater activation light 48 can be arranged to be visible to the smoker. In addition, the heater activation light 48 can be utilized for smoking article system diagnostics or to indicate that recharging is in progress. The light 48 can also be configured such that the smoker can activate and/or deactivate the light 48 for privacy, such that the light 48 would not activate during smoking if desired.

Preferably, the at least one air inlet 45 (FIG. 1) is located adjacent the puff sensor 16, such that the puff sensor 16 senses air flow indicative of a smoker taking a puff and activates the power supply 1 and the heater activation light 48 to indicate that the heatable portion 141 of the heater-wick element 14 is working.

A control circuit is preferably integrated with the puff sensor 16 and supplies power to the heater-wick element 14 responsive to the puff sensor 16, preferably with a maximum, time-period limiter.

Alternatively, the control circuitry may include a manually operable switch for a smoker to initiate a puff. The time-period of the electric current supply to the heater-wick element may be pre-set depending on the amount of liquid desired to be vaporized. Alternatively, the circuitry may supply power to the heater-wick element 14 as long as the puff sensor 16 detects a pressure drop.

Preferably, when activated, the heater-wick element 14 heats and volatilizes liquid in contact with the heater-wick element 14 for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

The invention claimed is:

1. An electronic vaping device comprising:

an integral heater-wick element configured to draw a pre-vapor formulation from a supply region and to heat the pre-vapor formulation, the integral heater-wick element including a foamed carbon, the foamed carbon having a density of about 0.1 to 1.0 g/cc and an open porosity of at least about 90%.

2. The electronic vaping device of claim 1, wherein the foamed carbon has an electrical resistance ranging from about 0.3 to about 10 ohms.

3. The electronic vaping device of claim 1, wherein the foamed carbon has an electrical resistance ranging from about 0.8 to about 5 ohms.

4. The electronic vaping device of claim 1, wherein the foamed carbon has impurities of less than about 100 ppm.

5. The electronic vaping device of claim 1, wherein the foamed carbon has impurities of less than about 10 ppm.

6. The electronic vaping device of claim 1, wherein the foamed carbon is resistant to oxidation up to at least about 400° C. in an oxygen atmosphere.

7. The electronic vaping device of claim 1, wherein the foamed carbon has a heat capacity of about 0.5 to 1.0 J/g-K.

8. The electronic vaping device of claim 1, wherein the foamed carbon has an open porosity of at least about 95%.

9. The electronic vaping device of claim 1, wherein the foamed carbon has a total porosity of at least about 70%.

10. The electronic vaping device of claim 1, wherein the foamed carbon has a total porosity of at least about 75%.

11. The electronic vaping device of claim 1, wherein the foamed carbon is a non-ceramic.

12. The electronic vaping device of claim 1, wherein the foamed carbon is a graphite foam or a carbon foam.

13. The electronic vaping device of claim 1, wherein the integral heater-wick element is structured to protect the pre-vapor formulation in the supply region from degradation by inhibiting an ingress of ambient oxygen into the supply region.

14. The electronic vaping device of claim 1, wherein the integral heater-wick element has a length ranging from about 10 to 15 mm.

15. The electronic vaping device of claim 1, wherein the integral heater-wick element has a width ranging from about 0.5 to 2.0 mm.

16. The electronic vaping device of claim 1, further comprising:

an electrical lead that is directly inserted into the integral heater-wick element to establish an electrical connection without soldering or brazing.

17. The electronic vaping device of claim 1, further comprising:

control circuitry electrically connected to the integral heater-wick element, the control circuitry configured to apply a voltage to the integral heater-wick element in response to a pressure drop.

18. The electronic vaping device of claim 1, further comprising:

control circuitry electrically connected to the integral heater-wick element, the control circuitry configured to apply a voltage to the integral heater-wick element in response to a manually-operable switch.

19. A method of producing a vapor in an electronic vaping device, comprising:

drawing a pre-vapor formulation from a supply region with an integral heater-wick element, the integral heater-wick element including a foamed carbon, the foamed carbon having a density of about 0.1 to 1.0 g/cc and an open porosity of at least about 90%; and heating the pre-vapor formulation from the supply region with the integral heater-wick element to produce a vapor.

20. The method of claim 19, wherein the heating includes applying a voltage to the integral heater-wick element in response to a pressure drop.

21. The method of claim 19, wherein the heating includes applying a voltage to the integral heater-wick element in response to a manually-operable switch.

* * * * *